US005115861A

United States Patent [19]

Laky

[11] Patent Number: 5,115,861

[45] Date of Patent: May 26, 1992

[54] TUBING GUIDE

[75] Inventor: Tibor Laky, Dallas, Tex.

[73] Assignee: Otis Engineering Corp., Dallas, Tex.

[21] Appl. No.: 692,562

[22] Filed: Apr. 29, 1991

[51] Int. Cl.[5] ..... E21B 19/00

[52] U.S. Cl. ..... 166/85; 166/96

[58] Field of Search ..... 166/77, 85, 96, 97.5, 166/77.5, 97

[56] References Cited

U.S. PATENT DOCUMENTS 2,262,490 11/1941 Crake ..... 166/96
4,467,864 8/1984 Crist ..... 166/96
4,476,936 10/1984 Boyadjiett et al. ..... 166/77 X
4,515,220 5/1985 Sizer et al. ..... 166/85 X
4,585,061 4/1986 Lyons, Jr. et al. ..... 166/77

*Primary Examiner*—William P. Neuder
*Attorney, Agent, or Firm*—M. H. Gay

[57] ABSTRACT

A tubing guide provides a window for installing or removing equipment on a tubing. The guide has pipe guards which are mounted for swinging movement to and away from support position and provides for easy installation and removal of inserts in the upper and lower beams to which the pipe guards are attached when guiding tubing.

10 Claims, 4 Drawing Sheets

TUBING GUIDE

This invention relates to a tubing guide for tubing and more particularly to a guide positionable between an injector or snubber and a well head. The guide confines the tubing and provides for attachment of well tools to the tubing.

Conventionally a quadpod has been positioned between a tubing injector and a well head to provide a vertical window for attaching equipment to a tubing. The quadpod vertical height is selected to provide the desired space to attach the equipment to the tubing. To support the tubing against buckling in the window, pipe guards have been provided which concentrically surround the tubing and give it support. These pipe guards have been heavy and difficult to handle and have required excessive time to remove and reassemble when it is desired to add or remove equipment from a tubing. A change in tubing size has required a complete redressing of the quadpod in the past.

In pods having a large vertical dimension the pipe guards have been provided in vertical sections bolted together. No lateral intermediate bracing was provided and the semicircular pipe guards were required to be massive enough to support the pipe without bracing.

It is an object of this invention to provide a tubing guide in which the pipe guards are supported from the pod legs for swinging movement between their tubing supporting position and an out of the way position to permit installing and removing equipment on the tubing.

Another object is to provide a tubing guide as in the preceding object in which the supports for the pipe guards provide lateral structural support for the pipe guards.

Another object is to provide a tubing guide in which sleeves are secured in the cross beams of the pod, annular bushings are removably carried in the sleeves to provide a selected large size support for a tubing and inserts may be removably carried in the bushings to provide support for smaller sized tubing.

Other objects, features and advantages of this invention will be apparent from the drawings, the specification and the claims.

In the drawings, wherein an illustrative embodiment is shown, and wherein like reference numerals indicate like parts:

Figure 1:
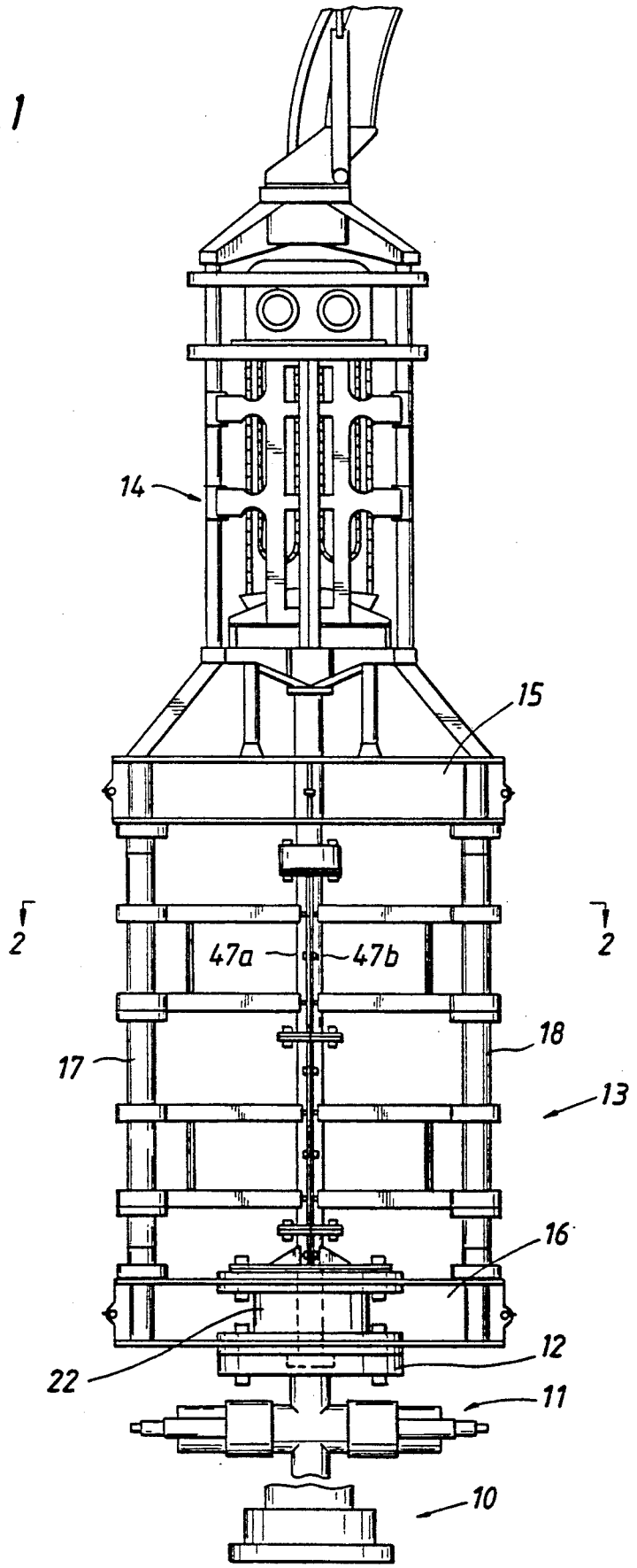
FIG. 1 is a view in elevation of a wellhead with a tubing guide supported thereon, and an injector supported on the tubing guide.

In FIG. 1 a wellhead indicated generally at 10 has mounted thereon a blowout preventer stack indicated generally at 11. The upper end of the stack has a flange 12 on which the tubing guide indicated generally at 13 is supported. A conventional injector indicated at 14 is supported on the pipe guide. This injector is of the endless belt design for handling reeled tubing but any desired form of injector such as a snubber may be utilized. For examples of these two types of injectors, see U.S. Pat. Nos. 3,866,679 and 3,999,610, the disclosures of which are incorporated herein by reference.

The tubing guide 13 includes upper and lower cross beams 15 and 16 respectively. The injector 14 is supported on the upper beam 15. The lower beam 16 is supported on the flange 12 of the blowout preventer stack. The cross beams are spaced vertically by a plurality of at least 3 support legs. Preferably four support legs 17, 18, 19 and 21 are utilized, providing with the beams a quadpod. As the support legs will be relied on to provide lateral support it is preferred that they be arranged symmetrically.

The lower beam 16 includes a lower sleeve which may be provided by a spool 22 having its lower flange secured to the flange 12 of the blowout preventer stack.

Figure 6:
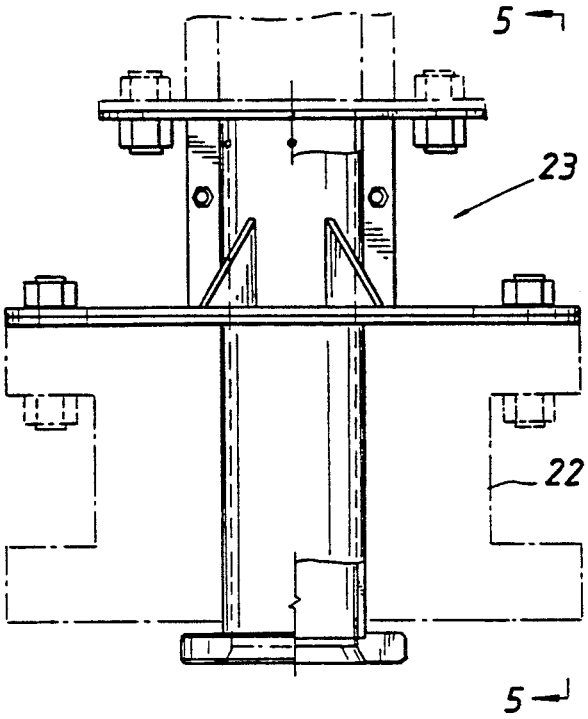
FIG. 6 is a view rotated 90 degrees from FIG. 5 of the lower bushing and showing the lower sleeve in phantom.
Figure 5:
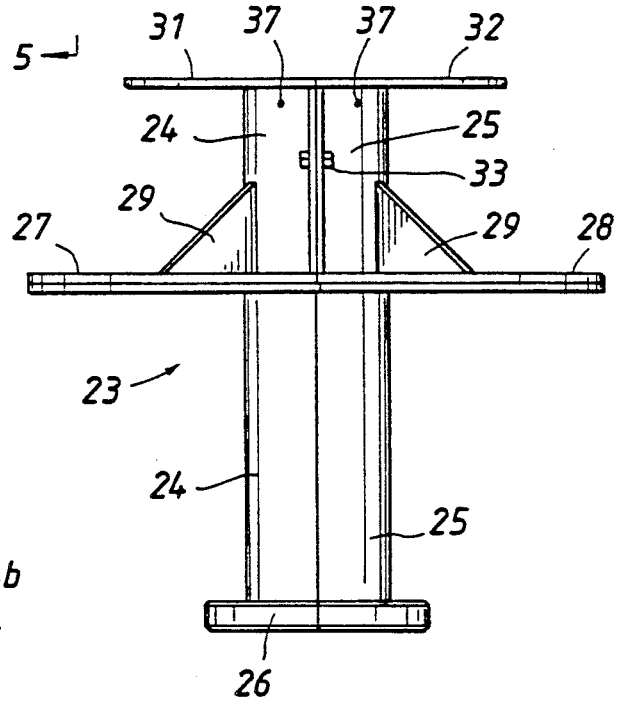
FIG. 5 is a view in elevation of the lower bushing.

Secured to the upper flange of spool 22 is a bushing indicated generally at 23. This bushing 23 is shown in FIGS. 5 and 6. The bushing includes a tubular member of a selected large size split into two halves 24 and 25. At its lower end the tubular member has an outturned flange 26 thereon of slightly smaller OD than the ID of the flange 12 so that the top of the blowout preventer stack provides support for the flange and thus the split halves 24–25 of the tubular member.

At an elevation to properly position the flange 26 each half 24 and 25 of the tubular member has welded thereon a radially outwardly extending plate or plates 27 and 28 respectively. In the design shown a double plate is utilized. Gussets 29 are welded to the tubular member and the plate to provide strength. At its upper end the two halves 24 and 25 have welded thereon radially extending half moon plates 31 and 32 for fastening to the pipe guards as will appear herein below. The two halves 24 and 25 are provided with vertical radially extending flanges which are in abuttment with the concave faces of the two halves confronting each other and suitable fasteners 33 secure the two halves together.

If it is desired to use the tubing guide to support a smaller size tubing than that for which the bushing is designed an insert may be positioned in the bushing.

Figure 7:
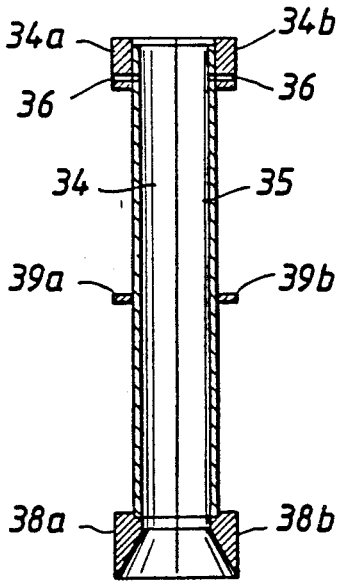
FIG. 7 is a sectional view of an insert for the lower bushing.

FIG. 7 illustrates a suitable insert designed to be supported in bushing 23. The insert is made from a split tubular member to form two semicircular members 34 and 35. An upper split flange **34*a*–34*b* is welded on the two halves and has radially extending threaded bolt holes 36 therein which register with bolt holes 37 in the bushing halves 24–25. At it lower end the insert has a split flange 38*a*–38*b* with a downwardly opening frustro-conical bore to prevent equipment hanging up on the insert. At an intermediate point on the insert an additional split flange 39*a*–39*b* may be provided. The insert flanges are sized to be slightly smaller than the bore through the bushing 23** and to be supported thereby.

The upper beam 15 includes a sleeve 41 having an outturned flange **41*a*. Within the sleeve 41 is a selected large size bushing formed from a tubular member split vertically to provide the two half sections 42*a* and 42*b***. The half sections are provided with outturned flanges 42*c* and 42*d* respectively for attachment to the outturned flange 41*a* on the bottom of sleeve 42 by suitable fasteners such as the bolts and nuts shown at 43. The bushing has an upwardly facing frustro-conical surface 44 for guiding tubing into the bushing. If it is desired to use a smaller tubing an insert formed from a tubular member split into two halves 45*a* and 45*b* is secured in the bore of the bushing. For this purpose the bushing is provided with holes and the insert with threaded holes for the bolts 46.

Selected different size upper and lower inserts may be provided for supporting different size tubing.

In the window between the upper bushing 42*a*–42*b* and the lower bushing 23 pipeguards are provided to support the tubing against bending. In accordance with this invention the pipe guards are mounted for swinging movement on the support legs. Depending on the length of the equipment to be attached to the pipe the support legs will be sized to provide an adequate window. In the illustrative embodiment two vertically spaced pipe guards are used. It will be appreciated that as few as 1 guard and as many as 4 or more may be used depending on the window desired.

Figure 4:
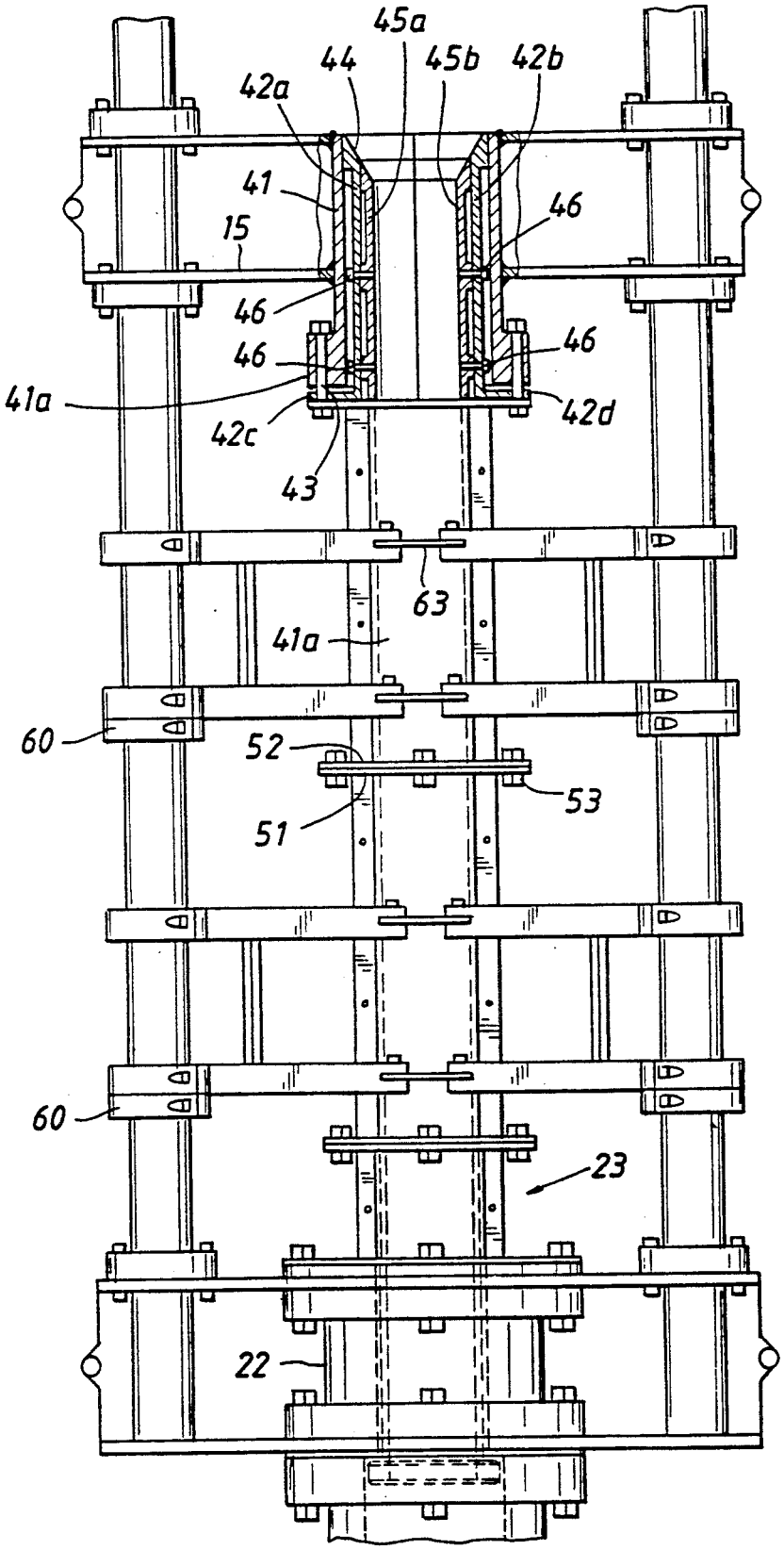
FIG. 4 is a view in elevation of the tubing guide with parts in section illustrating the upper sleeve, bushing and insert and a part of the lower bushing and an insert in phantom.

The pipe guards are provided by tubular members split vertically, preferably into two halves 47*a* and 47*b*. At the vertical diametral plane of the pipe guards, vertical outwardly extending flanges 49 and 50 (FIG. 2) are carried by the halves 47*a* and 47*b* and are secured together by bolts as shown. At the top and bottom of each pipe guard outturned flanges 51 and 52 are provided (FIG. 4). The intermediately positioned flanges 51 and 52 are secured together by fasteners such as bolts 53. The lowermost pipe guard flange is secured to the flange 31–32 on the lower bushing 23. The uppermost pipe guard flange is secured to the upper sleeve flange 41*a* by bolts 43. It is preferred that a slight space be provided between these two flanges and the bushing flange 42*c* when assembled to provide for clearance of the pipe guards when swinging from assembled to an out of the way position (see FIG. 4).

To provide for swinging movement of the pipe guards, they are carried by support arms. Preferably these arms are vertically spaced structural members 55 and 56 secured together by spacer 57. The members 55 and 56 are provided with bearings 58–59 and bearing caps 61–62 for mounting of the support arms for swinging movement on the support legs 17, 18, 19 and 21. The legs are provided with spaced collars 60 to support the arms at the proper elevation on the support legs.

Arm connecting plates are provided to connect the pipe guards to the support arms. Plates 63 and 64 are carried by the pipe guard sections 47*a* and 47*b* respectively and are connected to member 56 by fasteners. These may be bolts or pins 65. Like connecting plates connect between the pipe guards and the lower members 55 of each support arm. Lower plates are shown in FIG. 4.

Figure 2:
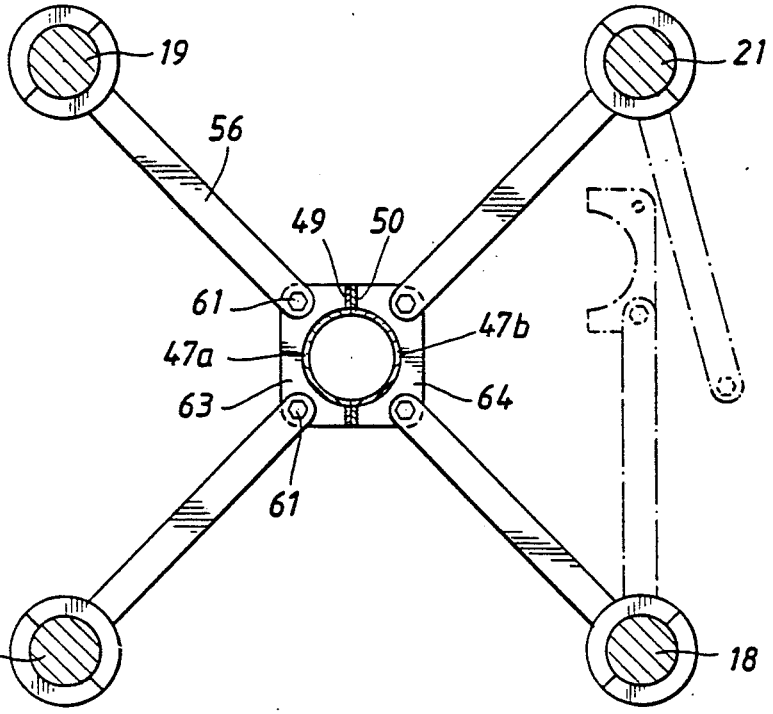
FIG. 2 is a view in section along the lines 2—2 of FIG. 1 with two support arms swung into an out of the way position in phantom, and the lower part of the tubing guide and wellhead omitted.
Figure 3:
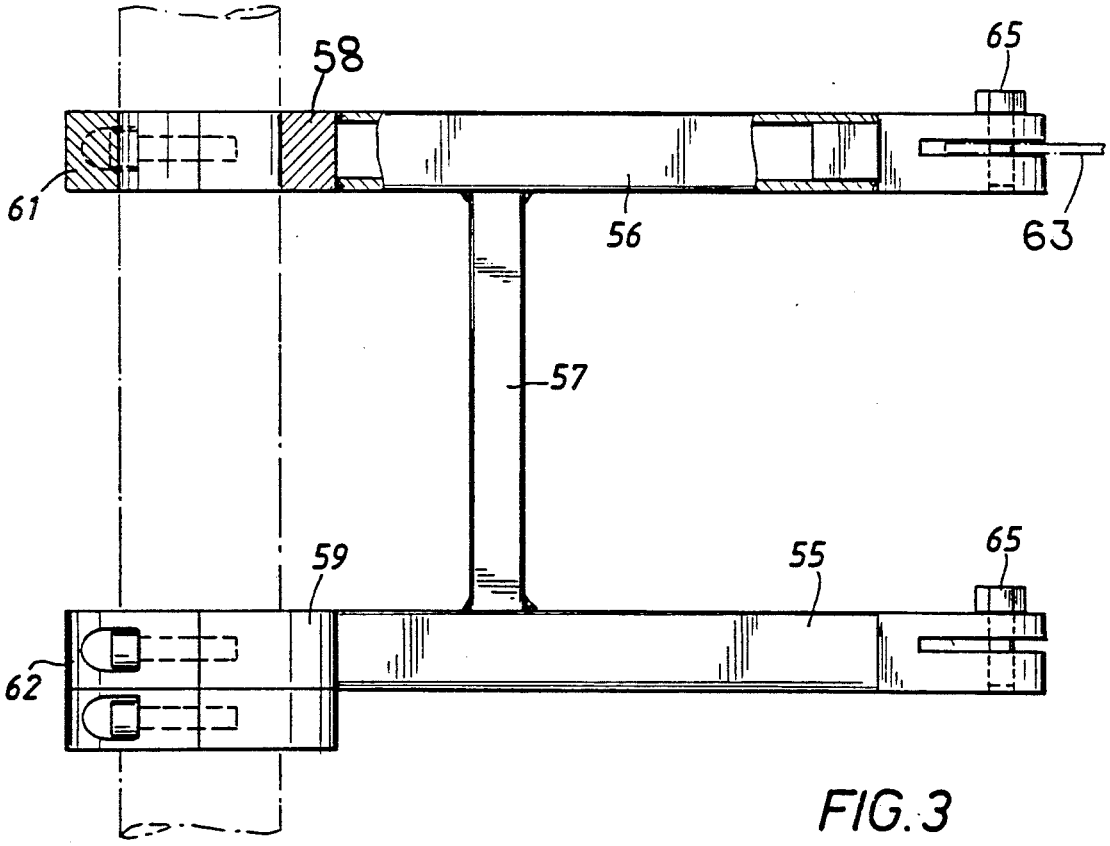
FIG. 3 is a view in elevation of a support arm with parts in section mounted on a support leg shown in phantom.

Preferably the support arms are arranged symmetrically as shown in FIG. 2 as they provide support in a lateral direction to the pipe guard sections. To utilize the quadpod with the larger size pipe guards the support arms may be attached to the connecting plates at closer points than shown to provide room for the larger pipe guard.

It is obvious that different sized pipe guards may be provided for guiding different size pipe by varying the sized of the pipe guard and the arm connecting plates.

In use the quadpod is mounted on the blowout preventer and the injector is mounted on the quadpod. The upper and lower bushings are installed in the upper and lower beams. If the tubing to be used calls for a smaller size support than the bushings provide, then upper and lower inserts are installed in the bushings. The inserts are preferably installed before the bushings are installed to guard against dropping an insert into the well. The proper size pipe guards are selected and mounted on two of the support arms. The arms are swung into the assembled position and pinned in place. the several flanges on the pipe guards and the upper sleeve and lower bushing are secured together as shown in FIG. 4. It should be noted that it is preferred to provide for swinging of the support arms about the support legs and for swinging of the arm connecting plates about their pins to facilitate positioning and removal of the pipe guards from assembled position.

While it is preferred to use four or more support legs and to use semicircular pipe guards this is not required and more or less number of legs and pipe guards split in unequal sections may be used.

The foregoing disclosure and description of the invention are illustrative and explanatory thereof and various changes in the size, shape and materials, as well as in the details of the illustrated construction, may be made within the scope of the appended claims without departing from the spirit of the invention.

What is claimed is:

1. A tubing guide comprising;

a pod adapted to be supported on a wellhead and to support means thereabove for injecting and retrieving tubing through the wellhead;

said pod having upper and lower vertically spaced horizontal beams and at least three vertical support legs extending between the beams and providing a window for attaching equipment to a tubing;

a support arm rotatably mounted on at least two support legs between said beams;

arm connecting plate means supported by at least one of said arms and connectable with the other arm or arms;

an annular pipe guard vertically split into sections and carried by said plate means;

means for connecting said pipe guard sections together in an annular relationship and with said upper and lower beams;

said supporting arms, connecting plate means and pipe guard constructed and arranged to position the pipe guard sections in engagement with their concave surfaces confronting each other to provide support for a tubing, and with all but the supporting arms released from said plate means permitting the plate means to swing into an out of the way position permitting attachment of equipment to a tubing;

said arms providing support for said pipe guard.

2. The guide of claim 1 wherein;

a sleeve is secured in the upper beam, a first bushing is secured in the sleeve, said first bushing having means for attaching thereto an insert positioned in the bore of said first bushing, a second sleeve is secured in the lower beam, a second bushing is secured in said second sleeve, said second bushing has means for attaching thereto an insert positioned in the bore of said second sleeve, and said connecting means connects said pipe guard sections to said first sleeve and second bushing.

3. The guide of claim 1 wherein;

a sleeve is secured in the upper beam, a first bushing is secured in the sleeve, said first bushing having means for attaching thereto an insert positioned in the bore of said first bushing, a second sleeve is secured in the lower beam, a second bushing is secured in said second sleeve, and said second sleeve has means for attaching thereto an insert positioned in the bore of said second sleeve, said connecting means connects said pipe guard sections to said first sleeve and second bushing, and smaller inserts are secured in said first and said second bushing.

4. The guide of claim 1 wherein;

a plurality of vertically spaced support arms, connecting plates and pipe guard sections are positioned between the upper and lower beams and the vertically spaced pipe guard sections are connected to each other.

5. The guide of claim 1 wherein the support arms are arranged symmetrically.

6. A tubing guide comprising;

a quadpod adapted to be supported on a wellhead and to support means thereabove for injecting and retrieving tubing through the wellhead;

said quadpod having upper and lower vertically spaced horizontal beams and four vertical support legs extending between the beams and providing a window for attaching equipment to a tubing;

a support arm rotatably mounted on each support leg;

vertically spaced arm connecting plates carried by two of said arms for rotation about a vertical axis and adapted to each be connected to another arm;

a semi-circular pipe guard section carried by each pair of spaced connecting plates;

means connecting said pipe guard sections together in annular relationship and with said upper and lower beams;

said supporting arms, connecting plates and pipe guard sections constructed and arranged with each plate connected to two arms to position the pipe guard sections in engagement with their concave surfaces confronting each other to provide support for a tubing, and with one arm released from each plate to swing into an out of the way position permitting attachment of equipment to a tubing;

said arms providing support for said pipe guard sections.

7. The guide of claim 6 wherein the support arms are arranged symmetrically.

8. The guide of claim 6 wherein;

a sleeve is secured in the upper beam, a first bushing is secured in the sleeve, said first bushing having means for attaching thereto an insert positioned in the bore of said first bushing, a second sleeve is secured in the lower beam, a second bushing is secured in said second sleeve, said second bushing has means for attaching thereto an insert positioned in the bore of said second sleeve, and said connecting means connects said pipe guard sections to said first and second sleeves.

9. The guide of claim 6 wherein;

a sleeve is secured in the upper beam, a first bushing is secured in the sleeve, said first bushing having means for attaching thereto an insert positioned in the bore of said first bushing, a second sleeve is secured in the lower beam, a second bushing is secured in said second sleeve, said second bushing has means for attaching thereto an insert positioned in the bore of said second sleeve, said connecting means connects said pipe guard sections to said first and second sleeves, and inserts are secured in said first and said second bushing.

10. The guide of claim 6 wherein;

a plurality of vertically spaced support arms, connecting plates and pipe guard sections are positioned between the upper and lower beams and the vertically spaced pipe guard sections are connected to each other.

* * * * *